US006241176B1

(12) United States Patent
McEntee

(10) Patent No.: US 6,241,176 B1
(45) Date of Patent: Jun. 5, 2001

(54) POLE-MOUNTED REEL FOR DECORATIVE LIGHT STRINGS

(76) Inventor: Dennis J. McEntee, 64 Evergreen Dr., Rochester, NY (US) 14624

( * ) Notice: Subject to any disclaimer, the term of this patent is extended or adjusted under 35 U.S.C. 154(b) by 0 days.

(21) Appl. No.: 09/416,296

(22) Filed: Oct. 14, 1999

(51) Int. Cl.[7] ..... B65H 75/40
(52) U.S. Cl. ..... 242/405.3; 242/588.2
(58) Field of Search ..... 242/405.3, 405.2, 242/407, 557, 546.1, 611, 588.2; 53/430

(56) References Cited

U.S. PATENT DOCUMENTS

| | | | | |
|---|---|---|---|---|
| 1,226,928 | * | 5/1917 | Updike . | |
| 4,014,477 | | 3/1977 | Hyun . | |
| 4,172,567 | | 10/1979 | Post . | |
| 4,883,178 | | 11/1989 | Thiele et al. | 206/391 |
| 4,917,323 | | 4/1990 | Wing . | |
| 5,328,543 | * | 7/1994 | Campagna | 156/577 |
| 5,598,985 | | 2/1997 | Winesett | 242/395 |
| 5,609,255 | | 3/1997 | Nichols | 206/576 |
| 5,661,953 | | 9/1997 | Jolley | 53/430 |
| 5,695,148 | | 12/1997 | Christensen | 242/405.3 |
| 5,868,334 | * | 2/1999 | Cedillo | 242/405.3 |

* cited by examiner

*Primary Examiner*—John M. Jillions
(74) *Attorney, Agent, or Firm*—Eugene Stephens & Associates

(57) ABSTRACT

A reel and pole combination facilitates winding and unwinding of light strings for outdoor displays. One or more reels have male threads on one axial end and female threads on an opposite axial end to mate with poles having male threads on one end and female threads on another. This allows a pole to be threaded to a reel in an orientation that lets a user turn the pole and reel for winding or unwinding light strings without loosening the threaded connection between the pole and the reel. Reels can be threaded together and threaded onto poles, and poles can be threaded together to increase the height of reach.

17 Claims, 2 Drawing Sheets

POLE-MOUNTED REEL FOR DECORATIVE LIGHT STRINGS

TECHNICAL FIELD

A reel mountable on a pole for unwinding or winding outdoor light strings onto or off from trees, bushes, buildings, and other objects.

BACKGROUND

Although millions of Christmas light strings are arrayed on trees, bushes, and many other support structures for outdoor display during the Christmas season, reels and poles for managing the unwinding and winding up of light strings remain less than satisfactory. Often, light strings become tangled when unwound and are manually positioned, usually with the aid of ladders. Winding the light strings back up again to take down an outdoor display is also inconvenient and time consuming with presently available tools.

The aim of this invention is a convenient, efficient, and labor-saving pole and reel combination that can speed up and make more pleasurable the process of positioning light strings in place and later removing them.

SUMMARY OF THE INVENTION

The inventive combination of a reel and pole for light strings provides respectively mating male and female threads at opposite ends of both a reel and a pole so that these can be screwed together in two different orientations. The orientation to be used is selected so that rotation of the pole for unwinding a light string tends to tighten the threaded connection between the pole and the reel, and an opposite orientation involving rotation of the pole for winding up a light string also tightens the threaded connection between the pole and the reel. With such an arrangement, a pair of reels can be threaded to each other and to a pole and pole extensions can be threaded to each other to increase the reach of the tool.

DRAWINGS

DETAILED DESCRIPTION

Figure 1:
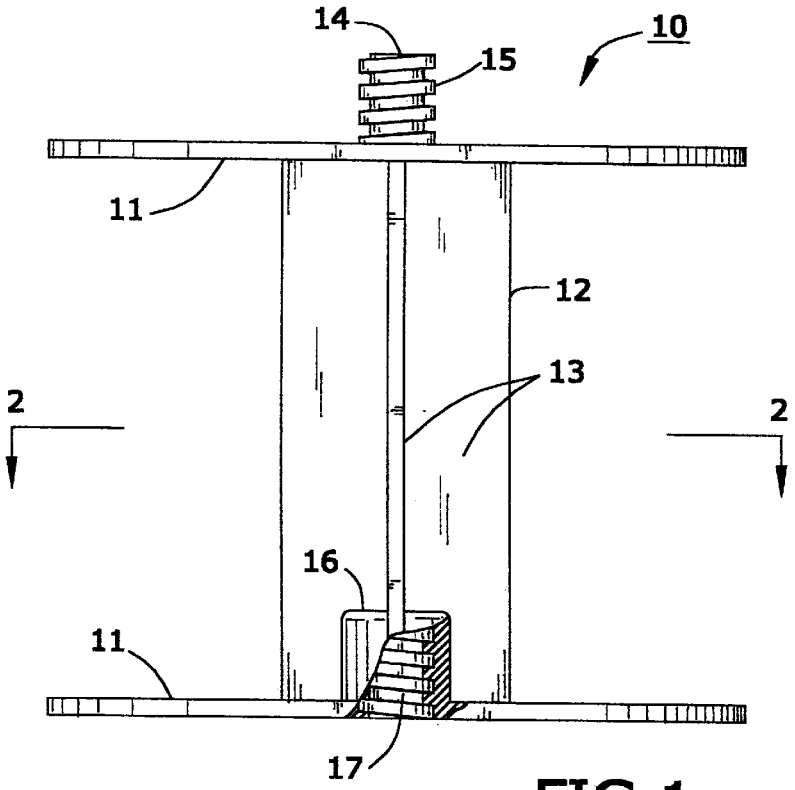
FIG. 1 is a partially cut-away elevational view of a preferred embodiment of reel according to the invention.
Figure 2:
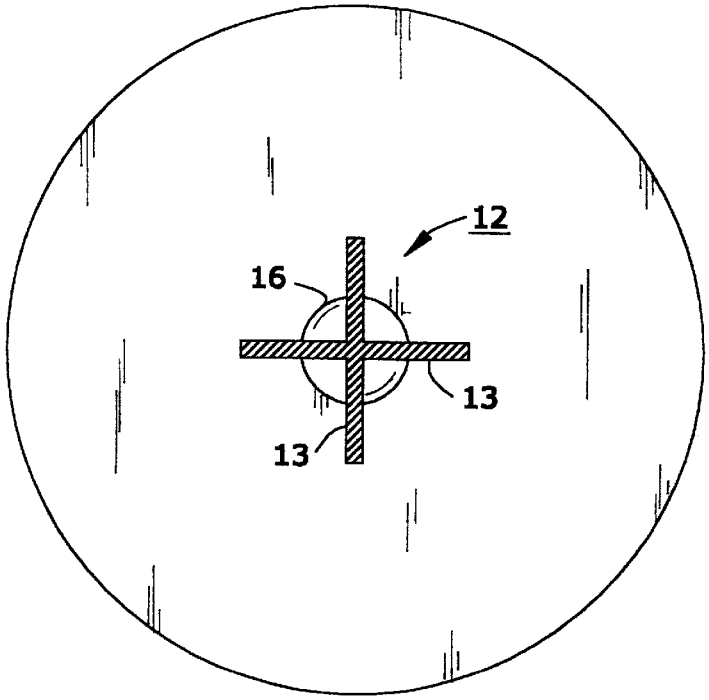
FIG. 2 is a cross-sectional view of the reel of FIG. 1, taken along the line 2—2 thereof.
Figure 3:
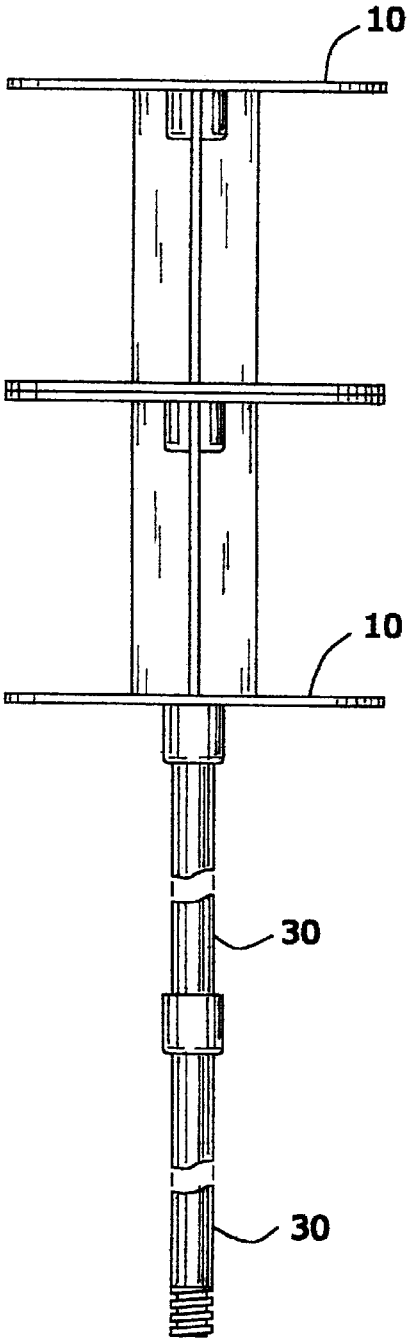
FIG. 3 is a partially cut-away elevational view of a pair of the reels of FIG. 1 screwed to a pair of poles.
Figure 4:
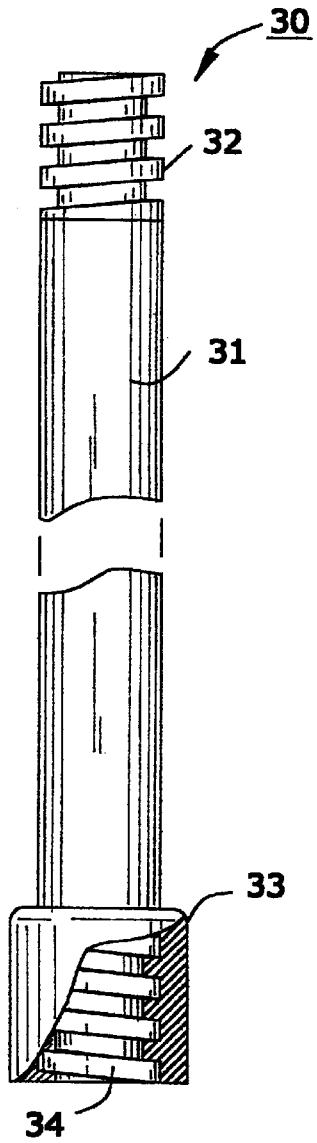
FIG. 4 is a partially cut-away view of a preferred embodiment of a pole for use with one or more reels.

One or more light string reels 10, as shown in FIGS. 1 and 2, can be threaded to one or more poles 30, as shown in FIGS. 3 and 4, in threaded orientations that facilitate either unwinding and arraying light strings or taking down and winding up light strings.

One or more poles 30 allow operation of reels 10 at elevated heights to avoid the necessity of ladders, and the connections between poles and reels are arranged so that whether light strings are being unwound or wound up, the poles can rotate the reels without loosening the screw connections between poles and reels.

As best shown in FIGS. 1 and 2, a preferred embodiment of reel 10 is made in a simple configuration that can be molded of plastic material. It includes a pair of flanges 11 and a winding core 12 formed of intersecting fins 13 in an X-configuration. On the central or winding axis of reel 10, at one end of reel 10, a projecting stud 14 forms male threads 15, and at an opposite axial end of reel 10, a socket 16 forms recessed female threads 17. Threads 15 and 17 are preferably configured in a standard form for broom handles, window cleaning tools, and the like.

Handles 30, as best shown in FIG. 4, include an axial shaft 31 having male threads 32 formed at one end and a socket 33 providing recessed female threads 34 at an opposite end. Threads 15, 17, 32, and 34 are preferably all equal sized to be mateable with one another. This allows threads 32 of pole 30 to be threaded into threads 17 of reel 10 or threads 34 of another pole 30. In turn, pole threads 34 can be threaded to reel threads 15 or to threads 32 of another pole 30. Reels 10 can also be threaded together, as shown in FIG. 3, by screwing male threads 15 of one reel into female threads 17 of another reel.

Light strings can be wound onto reels 10 in either clockwise or counterclockwise directions, as chosen by a user. The winding orientation can be determined by the way that a pole 30 is threaded to a reel 10 so that turning pole 30 and reel 10 in a winding direction tends to tighten the threaded connection between pole 30 and reel 10 as a light string is wound up. Unwinding such a light string by turning pole 30 and reel 10 would tend to loosen the original threaded connection between pole 30 and reel 10, but a user can avoid this by threading a pole 30 to a reel 10 in an opposite orientation in which turning the pole and the reel to unwind the light string tend to tighten the threaded connection between the pole and the reel. Especially when arranging light strings on trees and bushes, which is a popular form of outdoor display during the Christmas season, the user can hold the light string under light tension and turn the pole to unwind the light string only as required for placing the light string in a desired position. Since such turning tends to tighten the threaded connection between the pole and the light string, the tension placed on the light string does not unwind the reel from the pole. In a similar way, with an opposite threaded connection between a pole and reel, a user can keep a light tension on a light string as it is wound back up onto a reel 10.

Having two or more reels 10 mounted on one or more poles 30, as shown in FIG. 3, can increase the length of light strings that can be unwound or wound. The reach afforded by one or more poles 30 allows light strings to be arrayed or wound up at considerable heights, without requiring a ladder. The facility of the reel and pole combination for reaching to desired heights while winding or unwinding light strings kept under light tension speeds up the processes of stringing and unstringing lights and makes the job more pleasurable.

I claim:

1. A light string reel and pole combination comprising:

a. a reel having a winding axis with a male thread at one axial end and a female thread at an opposite axial end; and b. a pole having a mating male thread at one end and a mating female thread at an opposite end so that either end of the pole can be threaded to a mating thread of the reel to deploy the reel at an end of the pole for rotating the reel in a selected direction without unthreading the reel from the pole.

2. The combination of claim 1 including a pair of the reels threaded together with one of the reels threaded onto the pole.

3. The combination of claim 1 including an extension threaded to the pole.

4. The combination of claim 3 including a pair of the reels threaded together with one of the reels threaded onto the pole.

5. The combination of claim 1 wherein the reel and pole are molded of resin material.

6. A combination of a light string reel and a pole connectable to the reel for manipulating the reel at pole length, the combination comprising:

a. opposite ends of the reel having respective male and female reel threads arranged on an axis of the reel, and opposite ends of the pole having respective male and female pole threads arranged on an axis of the pole to mate with the reel threads so that the pole can be threaded to the reel in two different orientations; and b. the different orientations of the pole and the reel being selectable to allow the reel to be rotated at pole length for winding up or unwinding the light string without unscrewing the reel from the pole.

7. The combination of claim 6 including a pair of the reels screwed together by mating respective male and female threads of the reels.

8. The combination of claim 6 including a pair of the poles screwed together by mating respective male and female threads of the poles.

9. The combination of claim 6 wherein the reel and the pole are molded of resin material.

10. A method of unwinding a light string onto a tree or bush and winding up a light string from a tree or bush, the method comprising:

a. threading a light string reel onto a pole in an orientation so that a threaded connection between the reel and the pole tends to tighten as the pole is twisted to rotate the reel for unwinding the light string to place the light string on the tree or bush; and b. threading the reel on the pole in an opposite orientation so that a threaded connection between the reel and the pole tends to tighten as the pole is twisted to rotate the reel for winding up the light string from the tree or bush.

11. The method of claim 10 including threading a pair of reels together on the pole.

12. The method of claim 10 including threading a pair of the poles together to increase a height of reach of the reel.

13. A string reel and interconnectable pole comprising:

a. the reel being molded of resin material with threaded connections formed on an axis of the reel;

b. a male threaded connection projecting at one axial end of the reel;

c. a female threaded connection recessed at another axial end of the reel;

d. one end region of the pole having a projecting male thread mateable with the female thread on the reel; and e. another end of the pole having a recessed female thread mateable with the male reel thread.

14. The reel and pole of claim 13 including a plurality of the reels threaded to each other and to the pole.

15. The reel and pole of claim 13 including a plurality of the poles threaded to each other and to the reel.

16. The reel and pole of claim 13 including a plurality of the reels threaded to each other and a plurality of the poles threaded to each other and to the reels.

17. The reel and pole of claim 13 wherein the pole is molded of resin material.

* * * * *